US010759086B2

(12) United States Patent
Järvinen

(10) Patent No.: US 10,759,086 B2
(45) Date of Patent: Sep. 1, 2020

(54) METHOD AND APPARATUS FOR CASTING PREFABRICATED CONCRETE PRODUCTS

(71) Applicant: Elematic Oyj, Akaa (FI)

(72) Inventor: Lassi Järvinen, Valkeakoski (FI)

(73) Assignee: Elematic Oyj, Akaa (FI)

( * ) Notice: Subject to any disclaimer, the term of this patent is extended or adjusted under 35 U.S.C. 154(b) by 383 days.

(21) Appl. No.: 15/809,300

(22) Filed: Nov. 10, 2017

(65) Prior Publication Data

US 2018/0133923 A1 May 17, 2018

(30) Foreign Application Priority Data

Nov. 14, 2016 (FI) ..... 20165851

(51) Int. Cl.

| | |
|---|---|
| ***B28B 3/26*** | (2006.01) |
| ***B28B 23/18*** | (2006.01) |
| ***B28B 23/00*** | (2006.01) |
| ***B28B 3/22*** | (2006.01) |
| ***B28B 23/02*** | (2006.01) |
| ***B28B 1/08*** | (2006.01) |

(Continued)

(52) U.S. Cl.

CPC ..... *B28B 3/2645* (2013.01); *B28B 1/084* (2013.01); *B28B 1/085* (2013.01); *B28B 3/228* (2013.01); *B28B 3/2627* (2013.01); *B28B 11/02* (2013.01); *B28B 23/005* (2013.01); *B28B 23/0062* (2013.01); *B28B 23/02* (2013.01); *B28B 23/022* (2013.01); *B28B 23/18* (2013.01); *E04G 21/142* (2013.01)

(58) Field of Classification Search

CPC ..... B28B 3/2645; B28B 3/228; B28B 23/022; B28B 1/085; B28B 23/0062; B28B 3/2627; B28B 23/18; B28B 23/005; B28B 1/084; B28B 11/02; B28B 23/02; B28B 23/0067; E04G 21/142; B29B 1/085

See application file for complete search history.

(56) References Cited

U.S. PATENT DOCUMENTS 2,470,650 A * 5/1949 Russell ..... B28B 23/18 425/218
3,566,758 A * 3/1971 Perkins ..... E01C 23/04 404/100

(Continued)

FOREIGN PATENT DOCUMENTS

CN 1083763 A 3/1994
CN 104441208 A 3/2015

(Continued)

OTHER PUBLICATIONS

European Patent Office, European Search Report dated Apr. 25, 2018 in EP patent application No. 17200720.5.

(Continued)

*Primary Examiner* — Jeffrey M Wollschlager
(74) *Attorney, Agent, or Firm* — Berggren LLP

(57) ABSTRACT

Method and apparatus for casting prefabricated concrete products with a substantially horizontal slipform casting process, where the concrete mass is fed in at least one feeding stage to a slipform casting mold compacting and defining the product to be cast, wherein at least one part is embedded in the concrete mass after the at least one concrete mass feeding stage and before the final compaction of the upper surface of the product to be cast.

16 Claims, 2 Drawing Sheets

(51) Int. Cl.
*B28B 11/02* (2006.01)
*E04G 21/14* (2006.01)

(56) References Cited

U.S. PATENT DOCUMENTS

| | | | | | |
|---|---|---|---|---|---|
| 3,590,446 | A * | 7/1971 | Sonneville | B28B 1/10 | 425/125 |
| 3,608,012 | A | 9/1971 | Jonell et al. | | |
| 3,853,444 | A * | 12/1974 | Jones | B28B 23/0062 | 425/126.1 |
| 4,168,135 | A * | 9/1979 | Johansson | B28B 1/084 | 404/100 |
| 5,405,212 | A * | 4/1995 | Swisher, Jr. | E01C 23/04 | 404/100 |
| 6,494,410 | B2 * | 12/2002 | Lenz | A63H 19/24 | 246/122 A |
| 8,875,448 | B2 * | 11/2014 | Korkiamaki | B28B 23/0062 | 52/125.2 |
| 2010/0225023 | A1 * | 9/2010 | Badin | B28B 1/08 | 264/279 |
| 2014/0145361 | A1 * | 5/2014 | Raukola | B28B 1/084 | 264/40.5 |
| 2016/0214273 | A1 * | 7/2016 | Luotoharju | B28B 3/228 | |

FOREIGN PATENT DOCUMENTS

| | | | |
|---|---|---|---|
| DE | 2225413 | A1 | 12/1973 |
| DE | 3219139 | A1 | 11/1983 |
| DE | 3442918 | A1 | 5/1986 |
| DE | 3714581 | * | 11/1988 |
| DE | 102006029861 | A1 | 1/2008 |
| EP | 2821192 | A1 | 1/2015 |
| EP | 3056328 | A1 | 8/2016 |
| FR | 2172506 | A5 | 9/1973 |
| IT | 1039969 | B | 12/1979 |
| JP | H05138634 | A | 6/1993 |
| SU | 68466 | A1 | 11/1946 |

OTHER PUBLICATIONS

Chinese Patent Office, Search report dated Apr. 11, 2019 in the Chinese patent application No. 201710944302.8, 3 pages.
Search report, dated Apr. 27, 2017 of FI priority application No. 20165851.

* cited by examiner

METHOD AND APPARATUS FOR CASTING PREFABRICATED CONCRETE PRODUCTS

PRIORITY

This application claims priority of Finnish application FI 20165851 filed on Nov. 14, 2016 the contents of which are incorporated herein by reference.

FIELD OF THE INVENTION

The present invention relates to casting of prefabricated concrete products used in construction of buildings. More precisely the invention relates to a method and an apparatus for casting prefabricated concrete products with a slipform casting process.

BACKGROUND OF THE INVENTION

Prefabricated concrete products, such as hollow-core slabs and solid concrete slabs, are conventionally cast by slipform casting on long casting beds as a continuous casting process. The length of said continuous casting process is defined either on the basis of the total length of the elements to be cast, or on the basis of the maximum length of the casting bed. The length of casting beds used in slipform casting can be up to 150-200 m, depending on the size of the element plant. When a slipform casting equipment has cast a continuous slab on a casting bed, the cast concrete mass is allowed to be cured on the casting bed. After the concrete mass has cured, the uniform cast element is cut, generally by sawing, into pieces with predetermined lengths on the basis of the design characteristics of the ready-made elements, and the cut concrete elements are lifted off the casting bed to storage, to wait for transportation to their appointed targets of usage.

Several different slipform casting methods and devices are known in the art. The most common types of slipform casting methods for casting concrete products are extruder and slipformer methods. In the extruder method concrete mix is fed in a single feeding stage from a concrete mass container to feed screws which feed screws extrude the concrete mix to a slipform casting mold defined by upper surface of a casting bed and side and top plates of a casting machine. When casting hollow core slabs, the feed screws are followed by core forming mandrels forming the cores in form of longitudinal voids in the concrete product to cast. The compacting of the concrete product to be cast is achieved by vibrating and/or leveling motion of the side and top plates, and the forming of the cores is secured by back-and-forth compacting motion of an entity formed of the feed screw and the attached core mandrel. The casting machine moves along the casting bed driven by reaction force from the feed screws extruding the concrete mass and optionally with an additional drive motor. The ready cast product remains on the casting bed as the casting progresses. One known extruder-type casting machine and method are disclosed in publication EP 2 821 192, for example.

In the slipformer casting method concrete mix is fed at least in two feeding stages from a concrete mass container(s) to a slipform casting mold. In the first feeding stage concrete mass is fed to a lower portion of the casting mold formed by a top surface of a casting bed and side plates of a casting machine. The first feed stage of concrete mix is followed by vibrating shoes and core forming mandrels that by vibrating the concrete mix compacts the cast concrete mix and form the final shape of the lower part of the concrete product to be cast. In the second feeding stage concrete mix is fed onto the end portions of the core forming mandrels and on the previously cast concrete mix for casting the upper portion of the product to be cast, after which the concrete mix is compacted with a vibrating plate defining the upper surface of the slipform casting mold and located at the rear part of the casting machine. The ready cast product remains on the casting bed as the casting progresses.

Slipform casting is generally used for casting long products with uniform cross-section, such as massive or hollow core slabs, which are cut to predefined lengths after the cast concrete is cured.

The prefabricated slipform cast concrete products are often also provided with pre-tensioning strands, which provides additional strength, and thus increased loadbearing capability, to the concrete products. The slipform cast concrete products are generally used to form horizontal intermediate floor and similar structures in buildings. Slipform cast products can also be formed, in addition to hollow core or massive slabs, as poles, pillars and ribbed slabs, among others.

Different kinds of additional reinforcements and other items, such as lifting loop forming parts and welding plates, can be fixed to the pre-tensioning strands before casting, but this is often time-consuming, and the pressure of concrete mass, especially in extruder-type slipform casting, can move these parts. Thus many of these additional parts are added to the slipform cast concrete product after the casting manually or with different finishing machines.

Further, often the slipform casting mold restricts the addition of reinforcements and other parts to the pre-tensioning strands that extends from the outer surface of the slipform cast product. One solution for this problem is to use a sectional upper surface of the slipform casting mold, of which section can be arranged a suitable distance apart allowing reinforcements and other pieces to pass through the slipform casting mold and thus through whole slipform casting machine. this kind of solution is disclosed in publication EP 3 056 328.

BRIEF DESCRIPTION OF THE INVENTION

The present invention provides a novel method and apparatus for slipform casting or concrete products, where the addition of reinforcements and other parts to be at least partially embedded into the slipform cast product is implemented before the final compaction of the slipform cast product. This significantly speeds up the manufacturing process since the need for embedding these parts after the concrete product is compacted is eliminated or at least significantly reduced.

In the method of the invention for casting concrete products with a substantially horizontal slipform casting process the concrete mass is fed in at least one feeding stage to a slipform casting mold compacting and defining the product to be cast, and at least one part is embedded in the concrete mass via the upper surface of the product to be cast after the at least one concrete mass feeding stage and before the final compaction of the upper surface of the product to be cast.

The final compaction of the product to be cast is obtained by vibrating motion of compaction beam and troweling motion of side plates. When casting hollow-core slabs additional compaction is obtained from the troweling motion of the hollow core forming tubes. The vibrating compaction motion can be replaced with troweling compaction motion, and vice versa, as well as the combination of troweling and vibration compaction motion may also be used with the surfaces restricting the slipform casting mold.

In an embodiment of the method of the invention the at least one part is embedded only partially in the concrete mass and passes through the slipform casting mold through a gap in the top surface of the slipform casting mold. In this embodiment the top surface of the slipform casting mold comprises two or more section separated by the said gap.

In an embodiment of the method of the invention the at least one part is a reinforcement bar or a lifting loop forming part. Other parts may also be embedded into the product to be cast with the method of the invention, such as a fixing part for a parapet, a fixing part for a bracing utilized during installation of the concrete product, a fixing part for safety gear, or a bushing with inside thread, for example. The material of these parts is typically metal, such as steel, but they may be also made from other strong materials, especially the reinforcement bars, such as basalt fibers or carbon fibers for example.

In an embodiment of the method of the invention the concrete product to be cast is a hollow-core slab, and the at least one part is embedded in the area of the webs between hollow cores.

In an embodiment of the method of the invention the at least one part is embedded in the longitudinal end area of the product to be cast. This allows quick and cost efficient manufacturing of the end reinforced concrete slabs.

In an embodiment of the method of the invention the method is extruder-type or slipformer-type slipform casting method. Different kinds of combinations or variations of the said extruder-type and slipformer-type slipform casting methods may also be used with the present invention.

Further, in an embodiment of the method of the invention the embedding direction of the at least one part is adjustable, so that the parts orientation in the product to be cast can be changed to be suitable for different applications. This allows the embedding of the parts at different positions and orientations in a one and same concrete product to be cast, such as at the end areas of the concrete product to be cast, for example. The changing of the embedding direction can also be dependent on the position of the casting machine on a casting bed or on the casting distance, for example.

The present invention also provides an apparatus for casting concrete products with a substantially horizontal slipform casting process, wherein the apparatus comprises devices for feeding concrete mass in at least one feeding stage to a slipform casting mold compacting and defining the product to be cast, the apparatus further comprising devices for embedding at least one part in the concrete mass via the upper surface of the concrete product to be cast after the at least one concrete mass feeding stage and before the top surface of the slipform casting mold compacting the upper surface of the product to be cast.

In an embodiment of the apparatus of the invention the slipform casting mold comprises a top surface divided in sections, between which sections is provided a gap for allowing a partially embedded part to pass through the slipform casting mold.

In an embodiment of the apparatus of the invention the apparatus comprises hollow-core forming devices, such as hollow-core forming mandrels.

In an embodiment of the apparatus of the invention the embedding direction of the device for embedding the at least one part in the concrete mass is adjustable. This allows the embedding of parts in different positions in a one and same concrete product to be cast by tilting the device for embedding the at least one part during the casting process, such as when casting end reinforced concrete slabs where the angle of the embedded parts is opposite at different ends of the slab, for example. The change of the embedding direction of the device can be implemented to be dependent on the position of the casting machine on a casting bed or on the casting distance, for example.

Further, in an embodiment of the apparatus of the invention the apparatus is an extruder-type slipform casting machine, in which the concrete mass is fed from a concrete mass tank into the slipform casting mold with at least one feeding screw in a single feeding stage, or the apparatus is a slipformer-type slipform casting machine, in which the concrete mass is fed from a concrete mass tank into the slipform casting mold in at least two stages, or the apparatus is a combination of the extruder-type and slipformer-type slipform casting machines.

More precisely the features defining a method according to the present invention are disclosed in claim 1, and the features defining an apparatus according to the present invention are disclosed in claim 7. Dependent claims disclose advantageous features and embodiments of the invention.

Exemplifying embodiments of the invention and their advantages are explained in greater detail below and with reference to the accompanying drawings, where

DETAILED DESCRIPTION OF THE INVENTION

Figure 1:
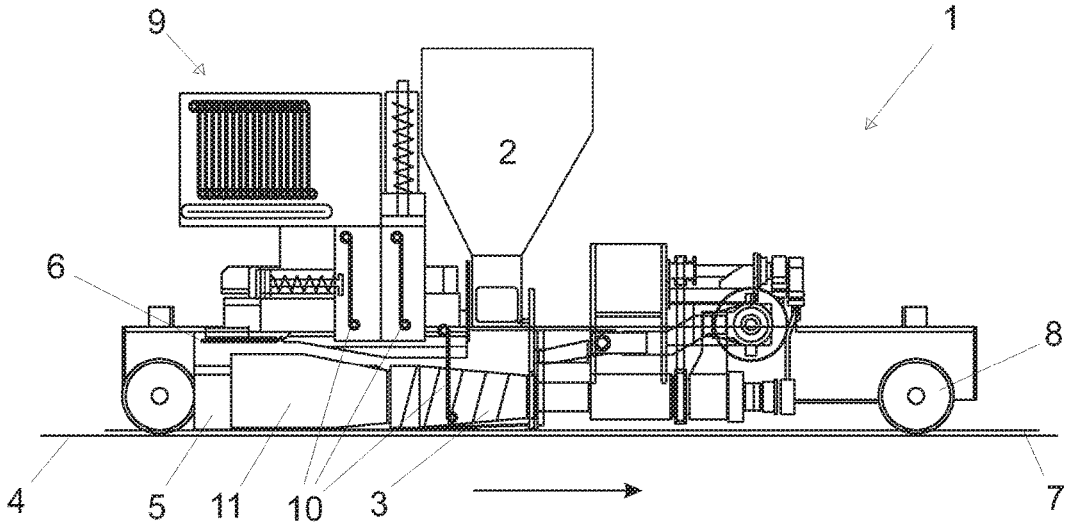
FIG. 1 shows schematically an embodiment of the apparatus of the invention.

In FIG. 1 is shown an embodiment of the apparatus of the invention, which apparatus in this embodiment is an extruder-type slipform casting machine 1. The casting machine 1 comprises a concrete mass tank 2, from which the concrete mass is fed to feed screws 3 extruding the concrete mass into a slipform casting mold formed by casting bed 4, side plates 5 and a top compaction beam 6. When casting hollow-core slabs (HCS) the feed screws 3 are followed by hollow-core forming mandrels 11. The casting machine 1 moves along the casting bed 4 via rails 7 with wheels 8, propelled by the reaction force of the feed screws 3 with help of drive machinery (not shown) in the direction of the arrow.

The casting machine 1 comprises an embedding device 9 for embedding parts 10 into the concrete product to be cast. The position of the embedding device 9 can be adjusted by tilting it in relation to the casting machine 1, so that the orientation of the embedded parts 10 may be adjusted in the concrete product to be cast. This tilting preferably takes place around a tilting axis extending horizontally perpendicularly in relation to the casting direction. This allows the embedding of the parts 10 in different positions in a one and same concrete product to be cast by tilting the embedding device 9 during the casting process, such as when casting end reinforced concrete slabs where the angle of the embedded parts is opposite at different ends of the slab, for example. In this solution the tilting of the embedding device can be implemented to be dependent on the position of the casting machine 1 or on the casting distance, for example. The operation and construction of the shown embodiment of the embedding device 9 will be discussed in more detail later in relation to FIG. 3.

In order to allow the upper ends of the embedded parts 10 extending above the upper surface of the product to be cast to pass the slipform casting mold, the top compaction beam 6 is formed in sections with gaps between the sections extending in the casting direction through the area of the compaction surface of the beam at the locations of the embedded parts.

Figure 2:
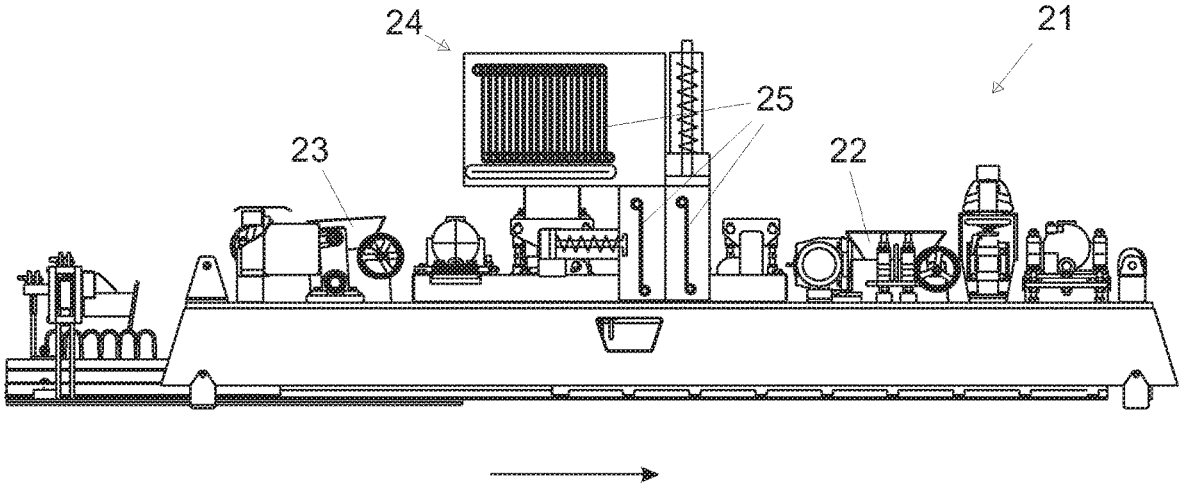
FIG. 2 shows schematically an alternative embodiment of the apparatus of the invention.

In FIG. 2 is shown an alternative embodiment of the apparatus of the invention, which apparatus in this embodiment is a slipformer-type slipform casting machine 21. In this embodiment the concrete mass is fed into the slipform casting mold in two feeding stages, in the first feeding stage via feed hopper 22, and in the second feeding stage via feed hopper 23. The casting machine 21 moves along the casting bed via rails propelled with drive machinery in the direction of the arrow in the figure.

The casting machine 21 comprises an embedding device 24 for embedding parts 25 into the concrete product to be cast. In this embodiment the embedding takes place after the first concrete mass feeding stage and before the second concrete mass feeding stage. The embedding device 24 is advantageously fixed to the casting machine 21 turnably, so that the orientation of the embedded parts 25 may be adjusted in the concrete product to be cast, such as discussed in relation to the embodiment of FIG. 1.

In this embodiment the top surface of the slipform casting mold is also advantageously divided into sections so that when parts 25 are only partially embedded in the product to be cast the portions of the parts extending from the upper surface of the product to be cast can pass through the slipform casting mold.

Figure 3:
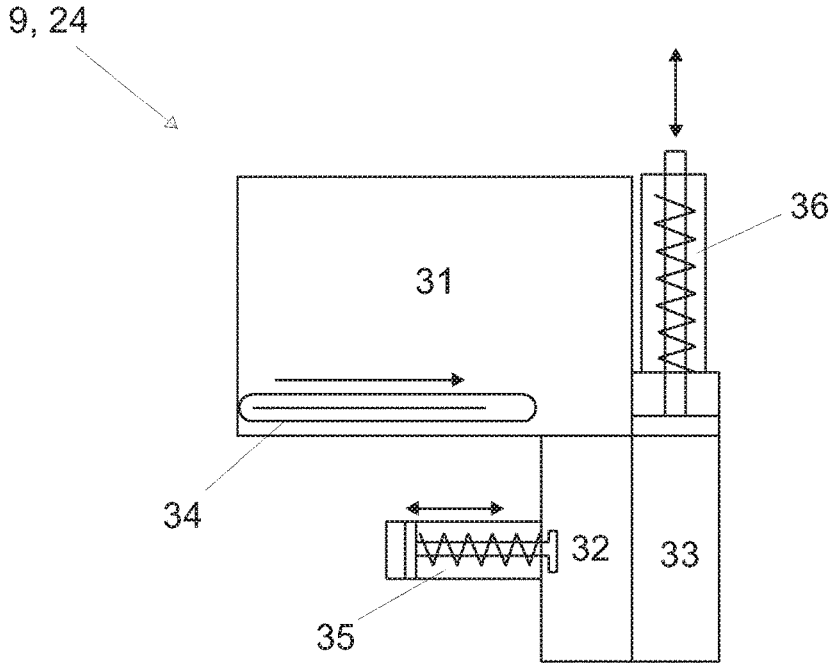
FIG. 3 shows schematically an embodiment of the embedding device for an apparatus of the invention.

FIG. 3 shows schematically an embodiment of the embedding device 9, 24 of the invention. In this embodiment the embedding device 9, 24 comprises three main sections: magazine 31, feeding section 32 and embedding section 33.

The magazine 31 is used to store a plurality of parts to be embedded in the product to be cast, and is equipped with means 34 for feeding the parts one by one into the feeding section 32. The means 34 can be implemented with a suitable conveyer belt, for example.

Once the part is fed from the magazine 31 into the feeding section 32, it is transferred with transfer means 35 to the embedding section 33. The transfer means 35 can be implemented with a pusher moved with a hydraulic cylinder, for example.

The part located in the embedding section 33 is then pushed out of the embedding device 9,24 and embedded in the product to be cast at suitable place and to the suitable depth with embedding means 36. These embedding means 36 can be implemented with a pusher moved with a hydraulic cylinder, for example.

The operation of the embedding device 9, 24 is also advantageously controlled by an automatic control system controlling the casting process of the slipform casting machine 1, 21. This enhances the correct positioning of the parts embedded in the product to be cast.

Figure 4A:
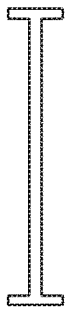
FIGS. 4A-4D show schematically examples of the parts to be embedded to a concrete product with the apparatus of the invention.
Figure 4B:
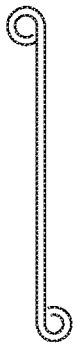
Figure 4C:
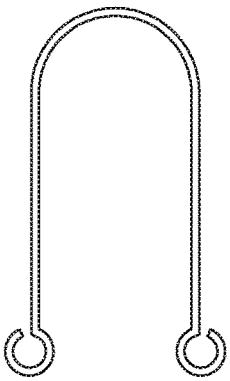
Figure 4D:
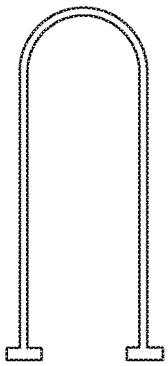

FIGS. 4A-4B show schematically examples of the parts to be embedded to a concrete product with the apparatus of the invention. FIGS. 4A and 4B shows examples of reinforcement bars, and FIGS. 4C and 4D shows examples of the parts forming a lifting loop.

Since in the present invention the parts are embedded into the concrete product before the final compaction of the product is attained, the parts sections located inside the product to be cast can be formed to contain larger sections so that good shape-based attachment and anchoring of the part to the concrete can be obtained. Further, the compaction taking place after the embedding of the part allows also better attachment of the concrete mass to the part at whole of its embedded length.

The material of the parts is generally metal, such as steel, but other high tensile strength materials, such as basalt fiber materials, may be used.

The specific exemplifying embodiments of the invention shown in the figures and discussed above should not be construed as limiting. A person skilled in the art can amend and modify the embodiments in many evident ways within the scope of the attached claims. Thus the invention is not limited merely to these described embodiments.

The invention claimed is:

1. A method for casting prefabricated concrete products with a substantially horizontal slipform casting process in a casting machine, the method comprising:

feeding a concrete mass in at least one feeding stage to a slipform casting mold compacting and defining a concrete product to be cast;

adjusting, during the substantially horizontal slipform casting process, an angular orientation of an embedding device with parts relative to the casting machine for adjusting directions of the parts to be embedded in the concrete product by tilting the embedding device;

embedding the parts having the adjusted directions in different positions of the concrete mass through an upper surface of the concrete product to be cast, where at least two of the embedded parts are oriented differently from each other; and finally compacting the upper surface of the concrete product to be cast.

2. The method according to claim 1, wherein at least one part of the embedded parts is embedded only partially in the concrete mass and passes through the slipform casting mold through a gap in a top surface of the slipform casting mold.

3. The method according to claim 1, wherein at least one part of the embedded parts is a reinforcement bar, a lifting loop forming part, a fixing part for a parapet, a fixing part for a bracing utilized during installation of the concrete product, a fixing part for safety gear, or a bushing with inside thread.

4. The method according to claim 1, wherein the concrete product is a hollow-core slab, and wherein at least one part of the embedded parts is embedded in a web area between hollow cores.

5. The method according to claim 1, wherein at least one part of the embedded parts is embedded in a longitudinal end area of the product to be cast.

6. The method according to claim 1, wherein the method is an extruder slipform casting method or a slipformer slipform casting method.

7. The method according to claim 1, wherein the method is a slipformer slipform casting method, and the concrete mass is fed to the slipform casting mold in two stages, a first stage and a second stage, using a first feed hopper and a second feed hopper respectively, so that the embedding of the parts is implemented after the first stage but before the second stage and the final compacting.

8. The method according to claim 1, wherein the adjusting of the angular orientation of the embedding device relative to the casting machine is around a tilting axis extending horizontally perpendicular to a casting direction.

9. The method according to claim 1, wherein, when casting an end reinforced concrete slab, angles of the embedded parts are opposite at different ends of the slab.

10. An apparatus for casting prefabricated concrete products with a substantially horizontal slipform casting process, the apparatus comprising:

at least one feeding hopper configured to feed a concrete mass to a slipform casting mold compacting and defining a concrete product to be cast;

an embedding device with parts configured to be angularly adjusted, during the substantially horizontal slipform casting process, relative to the apparatus for adjusting directions of the parts to be embedded in the concrete product by tilting the embedding device, and further configured to embed the parts with the adjusted directions in different positions of the concrete mass through an upper surface of the concrete product to be cast, where at least two of the embedded parts are oriented differently from each other; and at least one compaction beam, configured to finally compact the upper surface of the concrete product to be cast.

11. The apparatus according to claim 10, wherein the slipform casting mold comprises a top surface divided in sections, between which sections a gap is provided for allowing a partially embedded part to pass through the slipform casting mold.

12. The apparatus according to claim 10, wherein the apparatus comprises hollow-core forming devices.

13. The apparatus according to claim 10, wherein the at least one feeding hopper comprises a first feed hopper and a second feed hopper, so that the concrete mass is fed to the slipform casting mold in two stages, a first stage using the first feed hopper and a second stage using the second feed hopper, and the embedding of the parts is implemented after the first stage but before the second stage and the final compacting.

14. The apparatus according to claim 10, wherein the angular adjustment of the embedding device relative to the apparatus is around a tilting axis extending horizontally perpendicular to a casting direction.

15. The apparatus according to claim 10, wherein at least one part of the embedded parts is embedded only partially in the concrete mass and passes through the slipform casting mold through a gap in a top surface of the slipform casting mold.

16. The apparatus according to claim 10, wherein at least one part of the embedded parts is a reinforcement bar, a lifting loop forming part, a fixing part for a parapet, a fixing part for a bracing utilized during installation of the concrete product, a fixing part for safety gear, or a bushing with inside thread.

* * * * *